United States Patent [19]

Gentry et al.

[11] Patent Number: 4,474,238

[45] Date of Patent: Oct. 2, 1984

[54] METHOD AND APPARATUS FOR TREATMENT OF SUBSURFACE FORMATIONS

[75] Inventors: Cecil C. Gentry; Henry E. Alquist, both of Bartlesville, Okla.

[73] Assignee: Phillips Petroleum Company, Bartlesville, Okla.

[21] Appl. No.: 445,649

[22] Filed: Nov. 30, 1982

[51] Int. Cl.[3] ..... E21B 43/24

[52] U.S. Cl. ..... 166/268; 166/57; 166/245; 166/302

[58] Field of Search ..... 166/57, 245, 268, 302, 166/303; 299/4; 62/260; 405/130, 234, 55

[56] References Cited

U.S. PATENT DOCUMENTS

| | | | |
|---|---|---|---|
| 2,777,679 | 1/1957 | Ljungström | 166/256 X |
| 3,157,231 | 11/1964 | Darley | 166/9 |
| 3,183,675 | 5/1965 | Schroeder | 62/260 X |
| 3,251,191 | 5/1966 | Reed | 62/45 |
| 3,283,512 | 11/1966 | Hull | 61/0.5 |
| 3,295,328 | 1/1967 | Bishop | 61/0.5 |
| 3,302,707 | 2/1967 | Slusser | 166/245 |
| 3,344,607 | 10/1967 | Vignovich | 405/56 |
| 3,354,654 | 11/1967 | Vignovich | 61/0.5 |
| 3,830,305 | 8/1974 | Perkins | 166/302 |
| 3,905,422 | 9/1975 | Woodward | 166/245 |
| 4,125,159 | 11/1978 | Vann | 166/285 |

FOREIGN PATENT DOCUMENTS

| | | | |
|---|---|---|---|
| 55-53696 | 4/1980 | Japan | 165/45 |
| 1359378 | 7/1974 | United Kingdom | 165/45 |
| 162083 | 12/1961 | U.S.S.R. | 405/130 |

OTHER PUBLICATIONS

*American Society of Heating, Refrigerating, and Air-Conditioning Engineers Guide and Data Book,* Chapter 52, 1971, pp. 631-638.

*Primary Examiner*—Ernest R. Purser
*Assistant Examiner*—Timothy David Hovis
*Attorney, Agent, or Firm*—French, Hughes & Doescher

[57] ABSTRACT

A method of extracting bitumen from a subsurface tar sand bed wherein a shell of frozen earth is formed around the periphery of at least a portion of the tar sand bed, followed by recovering bitumen from such portion of the tar sand bed within the shell of frozen earth by suitable means such as, for example, solvent extraction. Also disclosed is apparatus for freezing the earth surrounding one of a plurality of boreholes drilled in the earth within earth freezing distance of each other around the periphery of such portion of the tar sand bed. The apparatus comprises concentric outer and inner conduits with the outer conduit having two strips of thermal insulation extending along substantially the full length of the exterior surface of the outer conduit, separated by two strips, preferably longitudinally finned, of relatively high thermal conductivity extending along substantially the full length of the exterior surface of the outer conduit so as to provide a predetermined freezing pattern about the axis of a borehole when refrigerant is circulated through the apparatus.

45 Claims, 5 Drawing Figures

METHOD AND APPARATUS FOR TREATMENT OF SUBSURFACE FORMATIONS

The present invention relates generally to treatment of subsurface formations. In one aspect the invention relates to apparatus for freezing subsurface earth. In another aspect the invention relates to a method of recovering carbonaceous material from the earth. In still another aspect the invention relates to a system for recovering carbonaceous material from the earth.

It has become increasingly desirable to produce carbonaceous material from subsurface tar sand beds. The production of such carbonaceous material, generally referred to as bitumen, from tar sands has not been particularly economically attractive in the past. With the increasing price of more economically produced petroleum, the production of bitumen from tar sands is becoming more economically attractive.

An object of the present invention is to provide an economically attractive process for producing bitumen from tar sands.

Another object of the invention is to provide an improved system suitable for the production of bitumen from tar sands.

Still another object of the invention is to provide improved apparatus for freezing the earth surrounding a borehole.

Another object of the invention is to provide a method of recovering bitumen from tar sands which is simple, economical, and efficient.

The present invention contemplates novel apparatus for freezing the earth surrounding a borehole in a predetermined pattern about the axis of the borehole. The apparatus includes first longitudinal tubular conduit means having a closed upper end and a closed lower end and having first connecting means at the closed upper end for connecting the interior of the first tubular conduit means in fluid flow communication with refrigerant input conduit means. The apparatus is further provided with second longitudinal tubular conduit means having a closed upper end and an open lower end and disposed within the first tubular conduit means with the open lower end of the second tubular conduit means positioned near the closed lower end of the first tubular conduit means. The second longitudinal tubular conduit means is further provided with second connecting means at the closed upper end thereof for connecting the interior of the second tubular conduit means in fluid flow communication with refrigerant output conduit means. The outer surface of the first tubular conduit means has at least one strip of relatively low thermal conductivity extending longitudinally along at least a portion of the outer surface of the first tubular conduit means between the first and second ends thereof. The outer surface of the first tubular conduit means further has at least one strip of relatively high thermal conductivity extending longitudinally along at least a portion of the outer surface of the first tubular conduit means.

The present invention further contemplates a method of recovering bitumen from a subsurface tar sand bed. This method includes drilling a plurality of generally downwardly extending boreholes spaced within earth freezing distance one from the other about the periphery of at least a portion of the tar sand bed. Refrigerant is circulated in the boreholes to freeze the earth surrounding each of the boreholes and the earth intermediate adjacent pairs of the boreholes to thereby form a shell of frozen earth around the periphery of at least a portion of the tar sand bed. The method further includes recovering bitumen from at least a portion of the tar sand bed within the shell of frozen earth.

The present invention also contemplates a system for recovering bitumen from a subsurface tar sand bed. The system includes a plurality of boreholes spaced within earth freezing distance one from the other about the periphery of at least a portion of the tar sand bed, as well as apparatus for freezing the earth surrounding a borehole in a predetermined pattern about the axis thereof positioned in each of the plurality of boreholes. The apparatus includes first longitudinal tubular conduit means having a closed upper end and a closed lower end, and further having first connecting means at the closed upper end for connecting the interior of the first tubular conduit means in fluid flow communication with refrigerant input conduit means. The apparatus also includes second longitudinal tubular conduit means having a closed upper and an open lower end and disposed with the first tubular conduit means with the open lower end of the second tubular conduit means positioned near the closed lower end of the first tubular conduit means. The second longitudinal tubular conduit means is also provided with second connecting means at the closed upper end thereof for connecting the interior of the second tubular conduit means in fluid flow communication with refrigerant output conduit means. The outer surface of the first tubular conduit means has at least one strip of relatively lower thermal conductivity extending longitudinally along at least a portion of the outer surface of the first tubular conduit means between the first and second ends thereof. The outer surface of the first tubular conduit means is further provided with at least one strip of relatively high thermal conductivity extending longitudinally along at least a portion the outer surface of the first tubular conduit means.

Other aspects, objects and advantages of the present invention will become readily apparaent from a reading of the remainder of this disclosure and the claims appended thereto with reference being had to the drawings in which:

Figure 1:
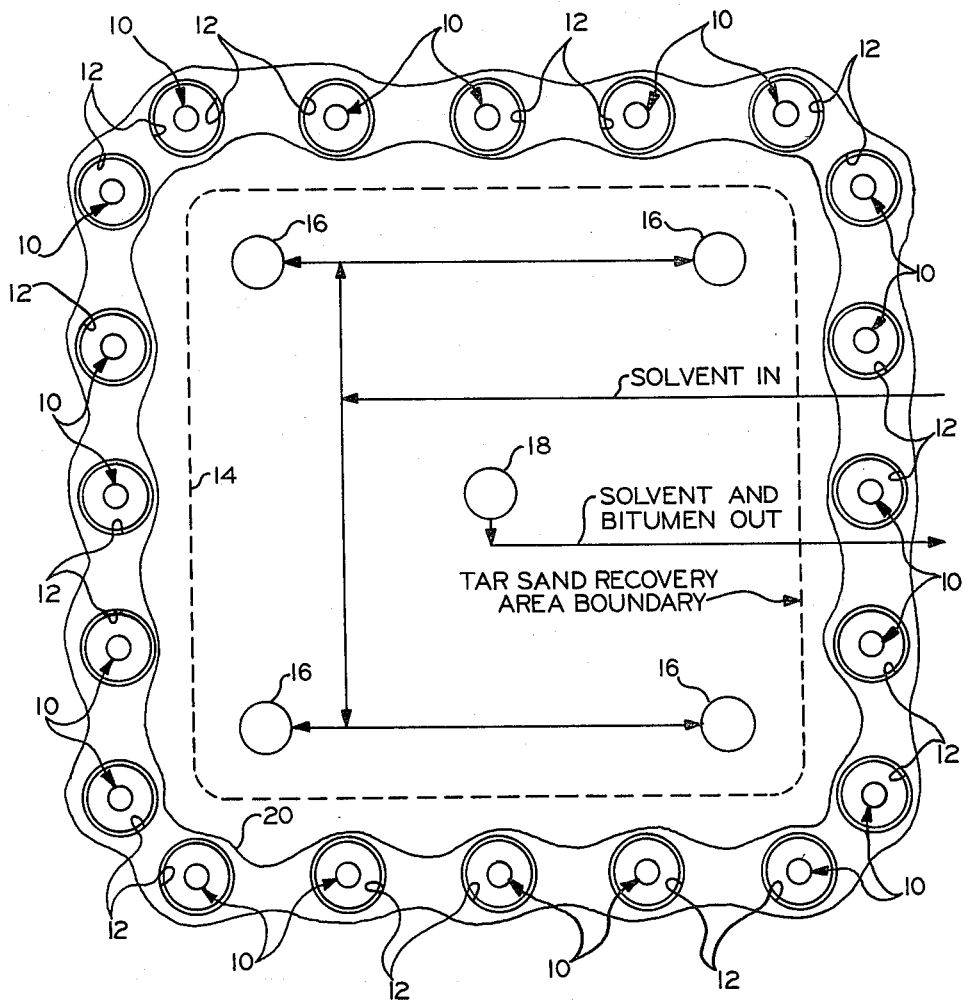
FIG. 1 is a plan view of the earth's surface in schematic form illustrating a tar sand recovery area and a system in accordance with the present invention for recovery of bitumen therefrom.
Figure 2:
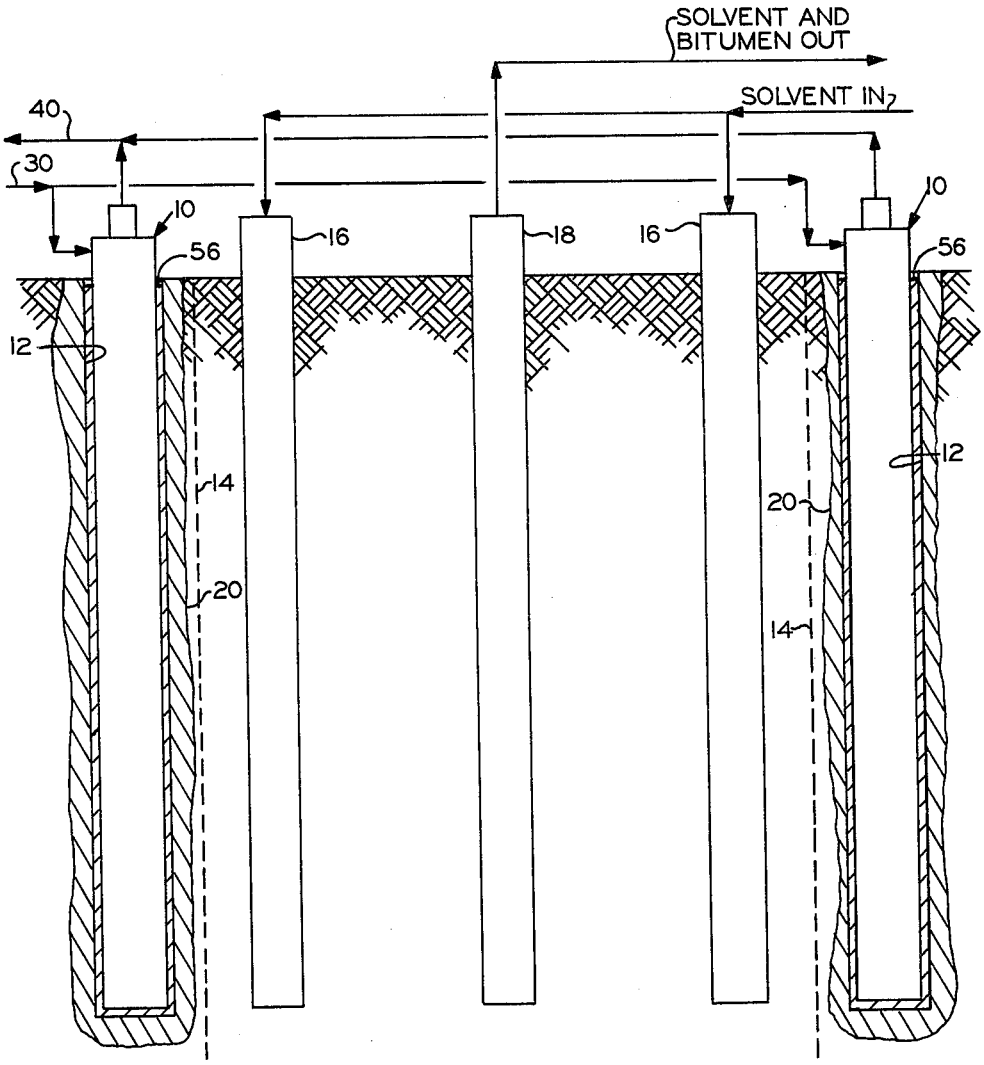
FIG. 2 is a diagrammatical elevational view of the tar sand recovery area and butimen recovery system of FIG. 1.
Figure 3:
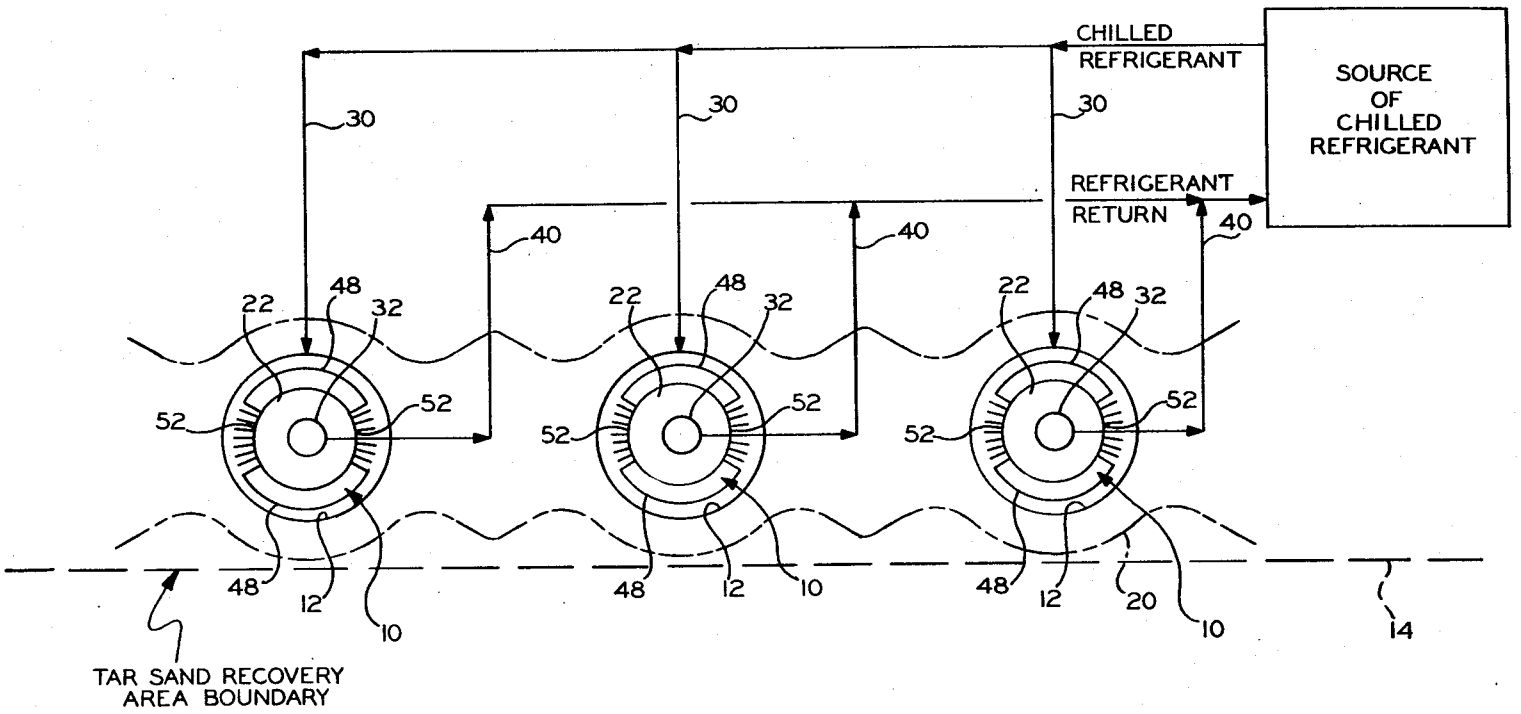
FIG. 3 is an enlarged portion of the plan view of FIG. 1 illustrating a portion of the bitumen recovery system in greater detail.

Referring now to the drawings, a system for performing the recovery of bitumen from a tar sand bed is illustrated in FIGS. 1, 2, and 3. The system comprises a plurality of earth freezing apparatus 10 disposed in respective ones of a plurality of downwardly extending boreholes 12 drilled in the earth surrounding the boundary 14 of at least a portion of a tar sand bed, which boundary forms the periphery of a tar sand recovery area. At least one injection well 16 is drilled into the earth-3 s surface penetrating the tar sand recovery area and is connected by suitable conduits to a source of solvent (not shown) which will dissolve the bitumen in the tar sand recovery area. At least one production well 18 is drilled into the tar sand recovery area and is connected by suitable conduits to a suitable receptacle (not shown) for receiving solvent and bitumen dissolved therein. As specifically illustrated, solvent is preferably injected into the four injection wells 16 under pressure and flows through the tar sand bed toward the production well 18 carrying with it bitumen dissolved therein from the tar sand bed to be produced from the production well 18. The thus produced solvent and bitumen dissolved therein can be separated by suitable means (not shown) to produce bitumen, and the separated solvent can be recycled, if desired, for reuse in the solvent extraction of bitumen from the tar sand recovery area.

The system of the present invention provides means for freezing the earth surrounding each of the boreholes 12 to thereby form a shell of frozen earth 20 around the tar sand recovery area defined by the boundary 14. By providing the shell of frozen earth 20 coextensive with the boundary 14, flow of the solvent into the tar sand recovery area is restricted thereto, thus preventing loss of the solvent from the tar sand recovery area into the surrounding subsurface formations. This restriction of the mobility of the solvent in the tar sand bed in the tar sand recovery area of interest eliminates or minimizes the loss of expensive solvent in the production of bitumen thereby increasing the efficiency of the bitumen recovery process and minimizing the cost thereof.

Figure 4:
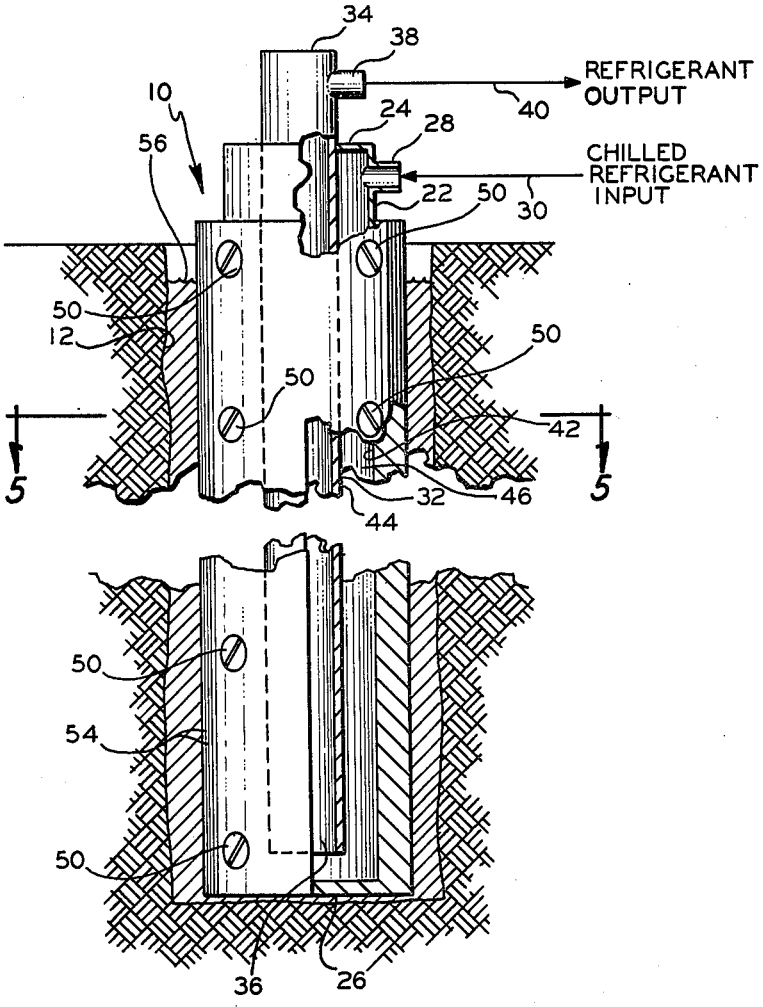
FIG. 4 is an elevational view of apparatus for freezing the earth surrounding a borehole with portions of the apparatus broken away along the longitudinal center line thereof to more clearly illustrate construction details.
Figure 5:
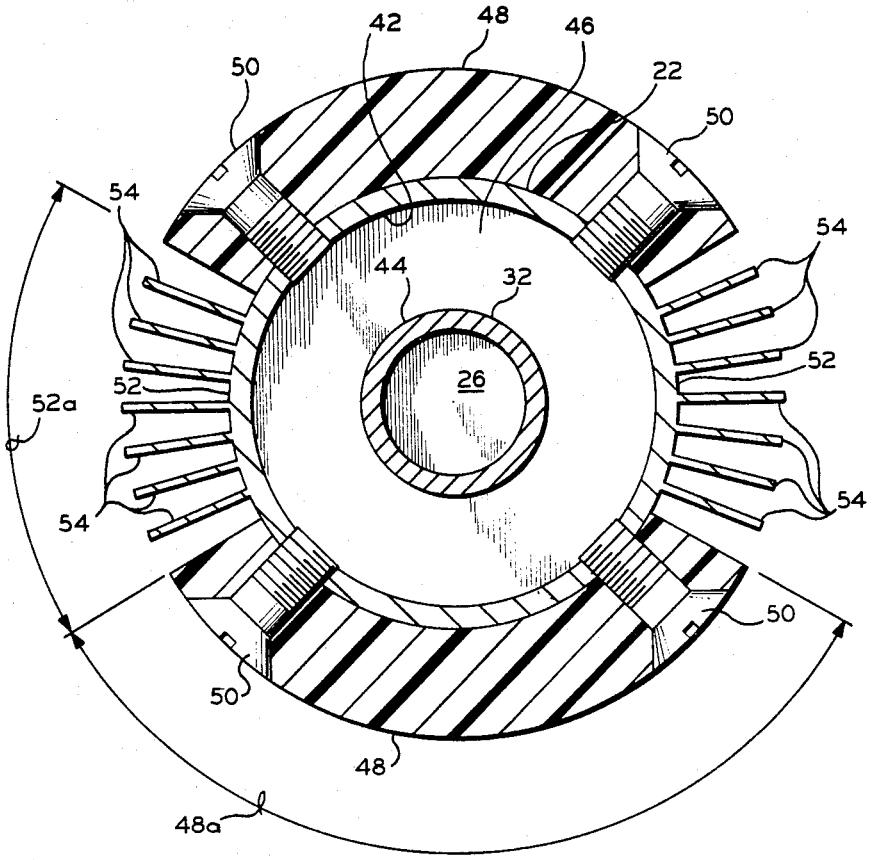
FIG. 5 is an enlarged cross sectional view taken along line 5—5 of FIG. 4.

The novel apparatus 10 employed in the system described above comprises a first longitudinal tubular conduit 22 having a closed upper end 24 and a closed lower end 26, as best shown in FIGS. 4 and 5. A suitable connecting fitting 28 is mounted on the closed upper end 24 of the conduit 22 and provides fluid flow communication between the interior of the first longitudinal tubular conduit 22 and a suitable refrigerant input conduit 30.

A second longitudinal tubular conduit 32 having a closed upper end 34 and an open lower end 36 is disposed within the first longitudinal tubular conduit 22 with the open lower end 36 of the second longitudinal tubular conduit 32 positioned near the closed lower end 26 of the first longitudinal tubular conduit 22 and with the closed upper end 34 of the second longitudinal tubular conduit 32 extending through and sealing engaged by suitable means with the closed upper end 24 of the first longitudinal tubular conduit 22. A connecting fitting 38 is mounted on the closed upper end 34 of the second longitudinal tubular conduit 32 and provides fluid flow communication between the interior of the second longitudinal tubular conduit 32 and a suitable refrigerant return conduit 40.

The inner surface 42 of the first longitudinal tubular conduit 22 and the outer surface 44 of the second longitudinal tubular conduit 32 define an annular passageway 46 through which chilled refrigerant is preferably passed downwardly from the earth's surface to the lowermost portion of the apparatus 10. Refrigerant is preferably returned from the lowermost portion of the apparatus 10 upwardly through the interior of the second longitudinal tubular conduit 32 and passes therefrom through connecting fitting 38 and conduit 40 for return to a suitable source of chilled refrigerant for recycling in the system. It will be understood that the previously described refrigerant flow through the apparatus 10 can be reversed if desired.

In order to more efficiently freeze the earth surrounding a borehole 12, the apparatus 10 is further provided with a pair of strips 48 of relatively low thermal conductivity secured to the exterior surface of the first longitudinal tubular conduit 22, preferably by means of machine screws 50 which extend through the strips 48 and are threadedly engaged with the conduit 22. It will be understood that a suitable thread seal between the threads of the machine screws 50 and the mating internal threads in the conduit 22 can be employed to prevent refrigerant leakage past the machine screws 50 if desired. In order to prevent moisture formation between the first longitudinal tubular conduit 22 and the thermal insulation strips 48, it is preferred to seal the strips 48 to the exterior surface of the conduit 22 by means of a suitable water-resistant adhesive. The thermal insulation strips 48 are disposed on opposite sides of the first longitudinal tubular conduit 22 and extend substantially the full length of the conduit 22. Each strip 48 preferably extends through an angle of about 120° about the longitudinal axis of the first longitudinal tubular conduit 22.

The first longitudinal tubular conduit 22 further includes a pair of strips of relatively high thermal conductivity 52 extending longitudinally along the exterior surface of the conduit 22 separating the two thermal insulation strips 48. The strips 52, preferably coextensive with the strips 48, extend substantially the full length of the first longitudinal tubular conduit 22. The strips 52 each preferably comprise a plurality of radially outwardly extending fins 54 which preferably extend longitudinally parallel to the longitudinal axis of the first longitudinal tubular conduit 22.

It is presently preferred to construct the first longitudinal tubular conduit 22, including the fins 54 thereof, of a suitable metal having relatively high thermal conductivity, satisfactory structural strength for the insertion thereof into a borehole and satisfactory resistance to any corrosive environment which might be encountered in the borehole. The fins 54 may be integrally formed on the longitudinal tubular conduit 22 by suitable means such as, for example, by extrusion, or they may be secured to the exterior surface of the conduit 22 by suitable means such as, for example, by welding. The second longitudinal tubular conduit 32 is preferably constructed of the same metallic material to avoid the electrolytic corrosive effects of dissimilar metals in the operating environment of the system. While the sizes of the conduits 22 and 32 may be any sizes capable of providing structural strength and fluid flow capacity desired, it is presently preferred to employ a first longitudinal tubular conduit 22 having a nominal outside diameter of about 2", with radially outwardly extending fins 54 extending about ½" outwardly from the outer surface thereof, and a second longitudinal tubular conduit 32 having a nominal outside diameter of about 1". It is also presently preferred to employ a strip of polytethylene approximately ½" thick for each of the thermal insulation strips 48.

The arrangement of the insulation strips 48 and fins 54 on the exterior of the first longitudinal tubular conduit 22 provides a predetermined freezing pattern about the longitudinal axis of the apparatus 10 and the borehole in which it is positioned in the system. As noted above, the thermal insulation strips 48 are preferably diametrically opposed to each other on the conduit 22 and each strip 48 preferably extends through an angle of about 120° about the longitudinal axis of the conduit 22, as shown at 48*a* in FIG. 5. The finned strips 52 preferably separate the thermal insulation strips 48, and each finned strip 52 preferably extends through an angle of about 60° about the longitudinal axis of the first longitudinal tubular conduit 22, as shown at 52*a* in FIG. 5. This arrangement of the strips 48 and 52 provides a freezing pattern, as shown by phantom lines in FIG. 3, wherein the earth adjacent the finned strips 52 is frozen to a greater distance from the longitudinal axis of the apparatus 10 than is the earth adjacent the thermal insulation strips 48. It is therefore advantageous to position the apparatus 10 in the boreholes 12 so that the finned strips 52 of each apparatus 10 are directed toward the finned strips 52 of the next adjacent apparatus 10 to thereby develop a more efficient freezing pattern for the shell of frozen earth 20, as shown in FIG. 3. It will also be noted that it may be advantageous to fill the annulus between each borehole 12 and the respective apparatus 10 disposed therein with water to facilitate the freezing of the earth surrounding the borehole 12, as shown at 56 in FIG. 4. While any suitable refrigerant may be employed in the earth freezing apparatus 10 and in the earth freezing system employing apparatus 10, it is presently preferred to employ chilled brine as the refrigerant or heat transfer medium for freezing the earth about a tar sand recovery area. Brine is often readily available in the field where bitumen recovery from tar sand beds may be performed.

From the foregoing disclosure, it will be seen that the method, system and apparatus of the present invention readily meet the recited objects set forth above. Changes can be made in the construction and arrangement of parts or elements as heretofore set forth in the specification and shown in the drawings without departing from the spirit and scope of the invention as defined in and limited only by the following claims.

That which is claimed is:

1. Apparatus for freezing the earth surrounding a borehole in a predetermined pattern about the axis of said borehole, comprising:

first longitudinal tubular conduit means having a closed upper end and a closed lower end and having first connecting means at the closed upper end for connecting the interior of said first tubular conduit means in fluid flow communication with refrigerant input conduit means;

second longitudinal tubular conduit means having a closed upper end and a open lower end and disposed within said first tubular conduit means with the open lower end of said second tubular conduit means positioned near the closed lower end of said first tubular conduit means and having second connecting means at the closed upper end of said second tubular conduit means for connecting the interior of said second tubular conduit means in fluid flow communication with refrigerant output conduit means; and the outer surface of said first tubular conduit means including two strips of relatively low thermal conductivity extending longitudinally along at least a portion of the outer surface of said first tubular conduit means between the first and second ends thereof, and further including two strips of relatively high thermal conductivity extending longitudinally along at least a portion of the outer surface of said first tubular conduit means, with said two longitudinally extending strips of relatively low thermal conductivity alternating with said two longitudinally extending strips of relatively high thermal conductivity about the longitudinal axis of said first longitudinal tubular conduit means and with each of said two longitudinally extending strips of relatively low thermal conductivity extending through an angle of about 120° about the longitudinal axis of said first longitudinal tubular conduit means.

2. Apparatus in accordance with claim 1 wherein each longitudinally extending strip of relatively high thermal conductivity comprises at least one fin extending radially outwardly from the longitudinal axis of said first longitudinal tubular conduit means.

3. Apparatus in accordance with claim 2 wherein said at least one fin extends longitudinally along substantially the full length of said longitudinally extending strip of relatively high thermal conductivity.

4. Apparatus in accordance with claim 1 wherein each said longitudinally extending strip of relatively low thermal conductivity comprises a strip of non-metallic thermal insulation material and each said longitudinally extending strip of relatively high thermal conductivity comprises a strip of metallic material.

5. Apparatus in accordance with claim 4 wherein each said longitudinally extending strip of relatively high thermal conductivity comprises at least one fin extending radially outwardly from the longitudinal axis of said first longitudinal tubular conduit means.

6. Apparatus in accordance with claim 5 wherein said at least one fin extends longitudinally along substantially the full length of said longitudinally extending strip of relatively high thermal conductivity.

7. Apparatus in accordance with claim 1 wherein each said longitudinally extending strip of relatively low thermal conductivity comprises a strip of polyethylene.

8. Apparatus in accordance with claim 1 wherein each of said two longitudinally extending strips of relatively high thermal conductivity extend through an angle of about 60° about the longitudinal axis of said first longitudinal tubular conduit means.

9. Apparatus for freezing the earth surrounding a borehole in a predetermined pattern about the axis of said borehole, comprising:

first longitudinal tubular conduit means having a closed upper end and a closed lower end and having first connecting means at the closed upper end for connecting the interior of said first tubular conduit means in fluid flow communication with refrigerant input conduit means;

second longitudinal tubular conduit means having a closed upper end and a open lower end and disposed within said first tubular conduit means with the open lower end of said second tubular conduit means positioned near the closed lower end of said first tubular conduit means and having second connecting means at the closed upper end of said second tubular conduit means for connecting the interior of said second tubular conduit means in fluid flow communication with refrigerant output conduit means; and the outer surface of said first tubular conduit means including two strips of relatively low thermal conductivity extending longitudinally along at least a portion of the outer surface of said first tubular conduit means between the first and second ends thereof, and further including two strips of relatively high thermal conductivity extending longitudinally along at least a portion of the outer surface of said first tubular conduit means, with said two longitudinally extending strips of relatively low thermal conductivity alternating with said two longitudinally extending strips of relatively high thermal conductivity about the longitudinal axis of said first longitudinal tubular conduit means and with each of said two longitudinally extending strips of relatively high thermal conductivity extending through an angle of about 60° about the longitudinal axis of said first longitudinal tubular conduit means.

10. Apparatus in accordance with claim 9 wherein each longitudinally extending strip of relatively high thermal conductivity comprises at least one fin extending radially outwardly from the longitudinal axis of said first longitudinal tubular conduit means.

11. Apparatus in accordance with claim 10 wherein said at least one fin extends longitudinally along substantially the full length of said longitudinally extending strip of relatively high thermal conductivity

12. Apparatus in accordance with claim 9 wherein each said longitudinally extending strip of relatively low thermal conductivity comprises a strip of non-metallic thermal insulation material and each said longitudinally extending strip of relatively high thermal conductivity comprises a strip of metallic material

13. Apparatus in accordance with claim 12 wherein each said longitudinally extending strip of relatively high thermal conductivity comprises at least one fin extending radially outwardly from the longitudinal axis of said first longitudinal tubular conduit means.

14. Apparatus in accordance with claim 13 wherein said at least one fin extends longitudinally along substantially the full length of said longitudinally extending strip of relatively high thermal conductivity.

15. Apparatus in accordance with claim 9 wherein each said longitudinally extending strip of relatively low thermal conductivity comprises a strip of polyethylene.

16. A method of recovering bitumen from a subsurface tar sand bed comprising:

drilling a plurality of downwardly extending boreholes spaced within earth freezing distance of each other about the periphery of at least a portion of said tar sand bed;

circulating refrigerant in said boreholes in such a manner as to freeze the earth surrounding said boreholes in a predetermined pattern about the axis of each of said boreholes, said pattern extending substantially farther radially outwardly along a first line through the axis of each borehole toward the next adjacent borehole through the axis of each borehole and substantially normal to said first line, thereby forming a shell of frozen earth around said periphery of at least a portion of said tar sand bed; and recovering bitumen from at least a portion of said tar sand bed within said shell of frozen earth.

17. A method in accordance with claim 16 wherein the refrigerant circulated in said boreholes is circulated through apparatus in each said borehole, said apparatus comprising:

first longitudinal tubular conduit means having a closed upper end and a closed lower end and having first connecting means at the closed upper end for connecting the interior of said first tubular conduit means in fluid flow communication with refrigerant input conduit means;

second longitudinal tubular conduit means having a closed upper end and an open lower end and disposed in said first tubular conduit means with the open lower end of said second tubular conduit means positioned near the closed lower end of said first tubular conduit means and having second connecting means at the closed upper end of said second tubular conduit means for connecting the interior of said second tubular conduit means in fluid flow communication with refrigerant output conduit means; and the outer surface of said first tubular conduit means having two strips of relatively low thermal conductivity extending longitudinally along at least a portion of the outer surface of said first tubular conduit means between the first and second ends thereof and further having two strips of relatively high thermal conductivity extending longitudinally along at least a portion of the outer surface of said first tubular conduit means, said two longitudinally extending strips of relatively low thermal conductivity alternating with said two longitudinally extending strips of relatively high thermal conductivity about the longitudinal axis of said first longitudinal tubular conduit means.

18. A method in accordance with claim 7 wherein each longitudinally extending strip of relatively high thermal conductivity faces a corresponding longitudinally extending strip of relatively high thermal conductivity of the apparatus in an adjacent borehole.

19. A method in accordance with claim 18 wherein each said longitudinally extending strip of relatively high thermal conductivity comprises at least one fin extending radially outwardly from the longitudinal axis of said first longitudinal tubular conduit means.

20. A method in accordance with claim 19 wherein said at least one fin extends longitudinally along substantially the full length of said longitudinally extending strip of relatively high thermal conductivity.

21. A method in accordance with claim 17 wherein each of said two longitudinally extending strips of relatively low thermal conductivity extends through an angle of 120° about the longitudinal axis of said first longitudinal tubular conduit means.

22. A method in accordance with claim 21 wherein each of said two longitudinally extending strips of relatively high thermal conductivity extends through an angle of about 60° about the longitudinal axis of said first longitudinal tubular conduit means.

23. A method in accordance with claim 20 wherein each of said two longitudinally extending strips of relatively high thermal conductivity extends through an angle of about 60° about the longitudinal axis of said first longitudinal tubular conduit means.

24. A method in accordance with claim 17 wherein water is present in at least one of said boreholes during the step of circulating refrigerant in said boreholes.

25. A method of recovering bitumen from a subsurface tar sand bed comprising:

forming a plurality of generally downwardly extending boreholes in the earth with said boreholes spaced within earth freezing distance one from the other about the periphery of at least a portion of said tar sand bed;

circulating refrigerant through apparatus in each of said boreholes to freeze the earth surrounding each of said boreholes and intermediate adjacent pairs of said boreholes to thereby form a shell of frozen earth around said periphery of at least a portion of said tar sand bed, said apparatus comprising:

first longitudinal tubular conduit means having a closed upper end and a closed lower end and having first connecting means at the closed upper end for connecting the interior of said first tubular conduit means in fluid flow communication with refrigerant input conduit means;

second longitudinal tubular conduit means having a closed upper end and an open lower end and disposed within said first tubular conduit means with the open lower end of said second tubular conduit means positioned near the closed the lower end of said first tubular conduit means and having second connecting means at the closed upper end of said second tubular conduit means for connecting the interior of said second tubular conduit means in fluid flow communication with refrigerant output conduit means; and the outer surface of said first tubular conduit means having at least one strip of relatively low thermal conductivity extending longitudinally along at least a portion of the outer surface of said first tubular conduit means between the first and second ends thereof, and further having at least one strip of relatively high thermal conductivity extending longitudinally along at least a portion of the outer surface of said first tubular conduit means; and recovering bitumen from said at least a portion of said tar sand bed within said shell of frozen earth.

26. A method in accordance with claim 25 wherein each longitudinally extending strip of relatively high thermal conductivity faces a corresponding longitudinally extending strip of relatively high thermal conductivity of the apparatus in an adjacent borehole.

27. A method in accordance with claim 26 wherein each said longitudinally extending strip of relatively high thermal conductivity comprises at least one fin extending radially outwardly from the longitudinal axis of said first longitudinal tubular conduit means.

28. A method in accordance with claim 27 wherein said at least one fin extends longitudinally along substantially the full length of said longitudinally extending strip of relatively high thermal conductivity.

29. A method in accordance with claim 25 wherein water is present in at least one of said boreholes during the step of circulating refrigerant in said boreholes.

30. A system for recovering bitumen from a subsurface tar sand bed comprising:

a plurality of boreholes spaced within earth freezing distance one from the other about the periphery of at least of portion of said tar sand bed;

apparatus for freezing the earth surrounding a borehole in a predetermined pattern about the axis thereof positioned in each of said plurality of boreholes, said apparatus comprising;

first longitudinal tubular conduit means having a closed upper end and a closed lower end and having first connecting means at the closed upper end for connecting the interior of said first tubular conduit means in fluid flow communication with refrigerant input conduit means;

said second longitudinal tubular conduit means having a closed upper end and an open lower end and disposed within said first tubular conduit means with the open lower end of said second tubular conduit means positioned near the closed lower end of said first tubular conduit means and having second connecting means at the closed upper end of said second tubular conduit means for connecting the interior of said second tubular conduit means in fluid flow communication with refrigerant output conduit means; and the outer surface of said first tubular conduit means including two strips of relatively low thermal conductivity extending longitudinally along at least a portion of the outer surface of said first tubular conduit means between the first and second ends thereof, and further including two strips of relatively high thermal conductivity extending longitudinally along at least a portion of the outer surface of said first tubular conduit means, with said two longitudinally extending strips of relatively low thermal conductivity alternating with said two longitudinally extending strips of relatively high thermal conductivity about the longitudinal axis of said first longitudinal tubular conduit means and with each of said two longitudinally extending strips of relatively low thermal conductivity extending through an angle of about 120° about the longitudinal axis of said first longitudinal tubular conduit means.

31. A system in accordance with claim 30 wherein each said longitudinally extending strip of relatively high thermal conductivity comprises at least one fin extending radially outwardly from the longitudinal axis of said first longitudinal tubular conduit means.

32. A system in accordance with claim 35 wherein said at least one fin extends longitudinally along substantially the full length of said longitudinally extending strip of relatively high thermal conductivity.

33. A system in accordance with claim 30 wherein each said longitudinally extending strip of relatively low thermal conductivity comprises a strip of non-metallic thermal insulation material and each said longitudinally extending strip of relatively high thermal conductivity comprises a strip of metallic material.

34. A system in accordance with claim 33 wherein each said longitudinally extending strip of relatively high thermal conductivity comprises at least one fin extending radially outwardly from the longitudinal axis of said first longitudinal tubular conduit means.

35. A system in accordance with claim 38 wherein said at least one fin extends longitudinally along substantially the full length of said longitudinally extending strip of relatively high thermal conductivity.

36. A system in accordance with claim 30 wherein each said longitudinally extending strip of relatively low thermal conductivity comprises a strip of polyethylene.

37. A system in accordance with claim 30 wherein water is present in at least one of said boreholes at least partially filling the annulus between said at least one of said boreholes and said apparatus positioned therein.

38. A system in accordance with claim 30 wherein each of said two longitudinally extending strips of relatively high thermal conductivity extends through an angle of about 60° about the longitudinal axis of said first longitudinal tubular conduit means.

39. A system for recovering bitumen from a subsurface tar sand bed comprising:

a plurality of boreholes spaced within earth freezing distance one from the other about the periphery of at least of portion of said tar sand bed;

apparatus for freezing the earth surrounding a borehole in a predetermined pattern about the axis thereof positioned in each of said plurality of boreholes, said apparatus comprising;

first longitudinal tubular conduit means having a closed upper end and a closed lower end and having first connecting means at the closed upper end for connecting the interior of said first tubular conduit means in fluid flow communication with refrigerant input conduit means;

said second longitudinal tubular conduit means having a closed upper end and an open lower end and disposed within said first tubular conduit means with the open lower end of said second tubular conduit means positioned near the closed lower end of said first tubular conduit means and having second connecting means at the closed upper end of said second tubular conduit means for connecting the interior of said second tubular conduit means in fluid flow communication with refrigerant output conduit means; and the outer surface of said first tubular conduit means including two strips of relatively low thermal conductivity extending longitudinally along at least a portion of the outer surface of said first tubular conduit means between the first and second ends thereof, and further including two strips of relatively high thermal conductivity extending longitudinally along at least a portion of the outer surface of said first tubular conduit means, with said two longitudinally extending strips of relatively low thermal conductivity alternating with said two longitudinally extending strips of relatively high thermal conductivity about the longitudinal axis of said first longitudinal tubular conduit means and with each of said two longitudinally extending strips of relatively high thermal conductivity extending through an angle of about 60° about the longitudinal axis of said first longitudinal tubular conduit means.

40. A system in accordance with claim 39 wherein each said longitudinally extending strip of relatively high thermal conductivity comprises at least one fin extending radially outwardly from the longitudinal axis of said first longitudinal tubular conduit means.

41. A system in accordance with claim 40 wherein said at least one fin extends longitudinally along substantially the full length of said longitudinally extending strip of relatively high thermal conductivity.

42. A system in accordance with claim 39 wherein each said longitudinally extending strip of relatively low thermal conductivity comprises a strip of non-metallic thermal insulation material and each said longitudinally extending strip of relatively high thermal conductivity comprises a strip of metallic material.

43. A system in accordance with claim 42 wherein each said longitudinally extending strip of relatively high thermal conductivity comprises at least one fin extending radially outwardly from the longitudinal axis of said first longitudinal tubular conduit means.

44. A system in accordance with claim 43 wherein said at least one fin extends longitudinally along substantially the full length of said longitudinally extending strip of relatively high thermal conductivity.

45. A system in accordance with claim 39 wherein each said longitudinally extending strip of relatively low thermal conductivity comprises a strip of polyethylene.

* * * * *

UNITED STATES PATENT AND TRADEMARK OFFICE

CERTIFICATE OF CORRECTION

PATENT NO. : 4,474,238

DATED : October 2, 1984

INVENTOR(S) : Cecil C. Gentry and Henry E. Alquist

It is certified that error appears in the above-identified patent and that said Letters Patent is hereby corrected as shown below:

Column 5, claim 1, line 11, "a" should be --- an ---.

Column 6, claim 9, line 11, "a" should be --- an ---.

Column 8, claim 18, line 1, "7" should be --- 17 ---.

Column 8, claim 23, line 1, "20" should be --- 17 ---.

Column 9, claim 25, line 17, after "closed", "the" should be deleted.

Column 10, claim 32, "35" should be --- 31 ---.

Column 10, claim 35, "38" should be --- 34 ---.

Signed and Sealed this

*Twenty-first* Day of *May 1985*

[SEAL]

*Attest:*

DONALD J. QUIGG

*Attesting Officer* *Acting Commissioner of Patents and Trademarks*